US006605793B2

(12) United States Patent
Banfield et al.

(10) Patent No.: US 6,605,793 B2
(45) Date of Patent: Aug. 12, 2003

(54) SLIDE ACTUATED SWITCH

(75) Inventors: Mark Jonathan Banfield, Dorset (GB); Barry Voss, Hampshire (GB)

(73) Assignee: ITW Limited, Swansea (GB)

( * ) Notice: Subject to any disclaimer, the term of this patent is extended or adjusted under 35 U.S.C. 154(b) by 0 days.

(21) Appl. No.: 10/042,392

(22) Filed: Jan. 11, 2002

(65) Prior Publication Data

US 2002/0088700 A1 Jul. 11, 2002

(30) Foreign Application Priority Data

Jan. 11, 2001 (GB) ..... 0100772

(51) Int. Cl.[7] ..... H01H 9/00
(52) U.S. Cl. ..... 200/573; 200/16 R; 200/573
(58) Field of Search ..... 200/16 R, 16 C, 200/16 D, 18, 547, 548, 551, 573, 574

(56) References Cited

U.S. PATENT DOCUMENTS

| | | | | |
|---|---|---|---|---|
| 2,875,287 A | | 2/1959 | Van Sickle | 200/5 |
| 4,389,551 A | | 6/1983 | Deibele et al. | 200/51 R |
| 5,293,143 A | * | 3/1994 | Sakakino et al. | 335/186 |
| 5,534,842 A | * | 7/1996 | Nagayama et al. | 337/402 |
| 6,204,458 B1 | * | 3/2001 | Chen et al. | 200/284 |

FOREIGN PATENT DOCUMENTS

| | | | |
|---|---|---|---|
| DE | 42 22 365 | 1/1994 | H02K/7/06 |
| DE | 43 09 132 | 9/1994 | H01H/13/52 |
| FR | 2 795 225 | 12/2000 | H01H/3/16 |

* cited by examiner

*Primary Examiner*—Michael Friedhofer
(74) *Attorney, Agent, or Firm*—Lowe Hauptman Gilman & Berner, LLP

(57) ABSTRACT

The switch includes a microswitch switching mechanism having a biassed plunger. The body of the switching mechanism is covered by a lid having a user-operated slider mounted thereon. Movement of the slider is confined to a track formed in the lid. A cam surface is provided on a part of the slider which is engageable with the plunger of the switching mechanism. The "over-centre" profile of the cam surface is such that movement of the slider in one direction causes the plunger to be depressed and then released. Inadvertent operation of the switch is avoided due to the cam profile.

20 Claims, 3 Drawing Sheets

SLIDE ACTUATED SWITCH

TECHNICAL FIELD

This invention relates to electrical switches and more particularly, though not solely, to slide actuated switches.

BACKGROUND OF THE INVENTION

Slide actuated switches come in a variety of forms. A common type has a strip of conductor material mounted on a slider and fixed contacts connected to terminals of the switch mounted in a body. Movement of the slider relative to the body moves the strip of conductor material into and out of contact with the fixed contacts to provide a switching action. Such a switch has only a slow make and break and is therefore only suitable for low voltage and low current applications. Another type of slide actuated switch relies upon the slider movement causing a pivoting movement of a conductor member from one to the other of two extreme positions. In the extreme positions the conductor member makes different connections with fixed contacts. Such a switch has a "snap-over" action and so speeds up the make and break connection but it is still only useful with relatively low currents.

Another very common type of switch which is in widespread use is a so-called "microswitch". Such switches normally have at least three terminals which provide a normally OFF function and a normally ON function. Such switches can include more terminals and may have a changeover function. Typically such microswitches include an actuating plunger and it is movement of the plunger into and out of the body of the microswitch which actuates the switching function. Such microswitches are quite often incorporated into push-button type switches but they can include a lever pivotally mounted on the body which engages and operates the plunger. The free end of such a lever may include a roller so that it can operate with a profiled rotary cam. Such microswitches are a commodity item and accordingly inexpensive and they can handle relatively high currents and voltages, typically 250 volts at 10 amps.

SUMMARY OF THE INVENTION

According to this invention a slider actuated switch comprises a microswitch switching mechanism including a biassed plunger mounted in a body, a slider mounted on and co-operating with the body so that it is capable of sliding backwards and forwards along the body, and a cam associated with the slider and engaging the biassed plunger as the slider is moved backwards and forwards to operate the plunger and thereby actuate the microswitch switching mechanism.

Preferably the microswitch switching mechanism is entirely conventional in construction and preferably it is of a type that includes a body formed in two parts, a first part which contains and forms part of the switching mechanism and a second part or lid. In this case the lid is modified to provide a track which constrains and cooperates with the slider to control its movement in the backwards and forwards direction.

Preferably the cam is profiled to provide an "overcentre" action. Thus, with the slider at one extreme position of its travel the slider is either out of contact with the plunger or at least only just touching the plunger. As the slider is moved towards the other extreme of its travel the cam is profiled to engage the plunger and depress it to its fully depressed position as the slider is in the centre of its travel and then to release the plunger slightly when the slider reaches the other extreme end of its travel. In this way, the bias of the plunger has to be overcome when any attempt is made to return the slider to its starting point and consequently this prevents the slider moving under vibration alone, for example.

Typically sliding switches in accordance with this invention are stacked next door to one another to provide a gang of slider switches and, in this case, each microswitch preferably includes two tangs so that each slider switch engages the walls of a surrounding mounting frame or case holding the gang of slider switch assemblies in position side-by-side. When the switch is to be used in this fashion one side of the track formed by the lid can be entirely open to facilitate the assembly of the slider with the track and then, once a number of switches are arranged side-by-side the sliders in each switch are prevented from being removed from the track either by the neighbouring slider actuated switch or by the side wall of the mounting frame or case in which all of the slider switches are mounted.

BRIEF DESCRIPTION OF THE DRAWINGS

A particular example of the slider actuated switch in accordance with this invention will now be described with reference to the accompanying drawings, in which.

DETAILED DESCRIPTION OF THE PREFERRED EMBODIMENT

Figure 1:
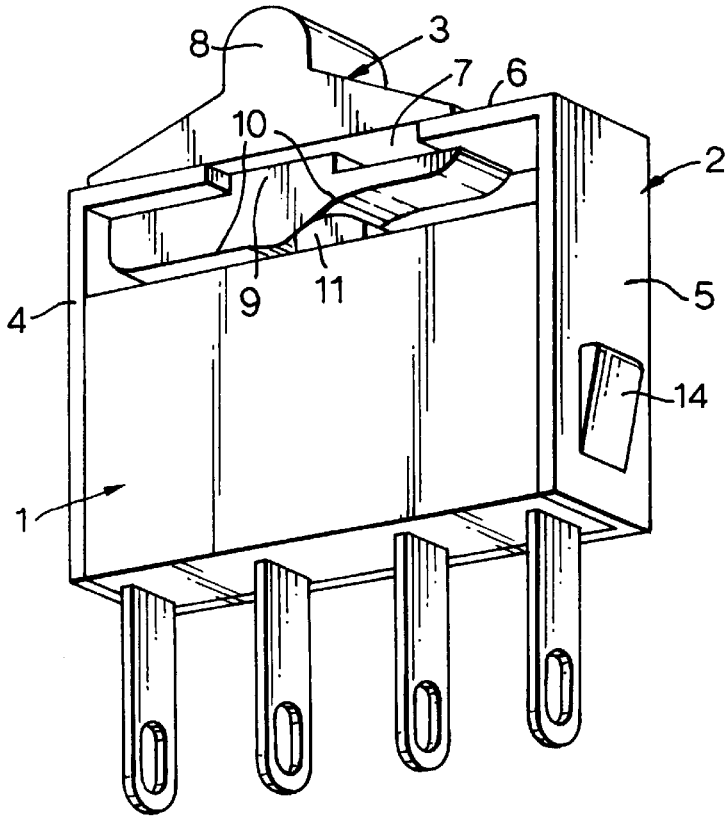
FIG. 1 is a perspective view of the complete switch.

The slider actuated switch comprises a standard microswitch 1 such as an ITW type 16 microswitch made and sold by ITW Switches of Norway Road, Hilsea, Portsmouth, Hampshire, PO3 8HT, United Kingdom, a frame 2 and a slider 3. The frame 2 forms and replaces the lid of the otherwise conventional microswitch 1 and includes a rear face, side faces 4 and 5 and an interrupted top face 6 including an aperture 7. The slider 3 includes an actuator 8 for engagement by the user and a foot 9 including a profiled cam surface 10. The foot 9 extends through the aperture 7 in the top wall 6 of the frame 2 and slots formed between the actuator 8 and the foot 9 embrace the interrupted top wall 6 to locate the slider 3 in position and control its movement backwards and forwards along the top of the frame 2. The profiled cam surface 10 engages a spring-loaded plunger 11 of the microswitch 1.

Figure 2:
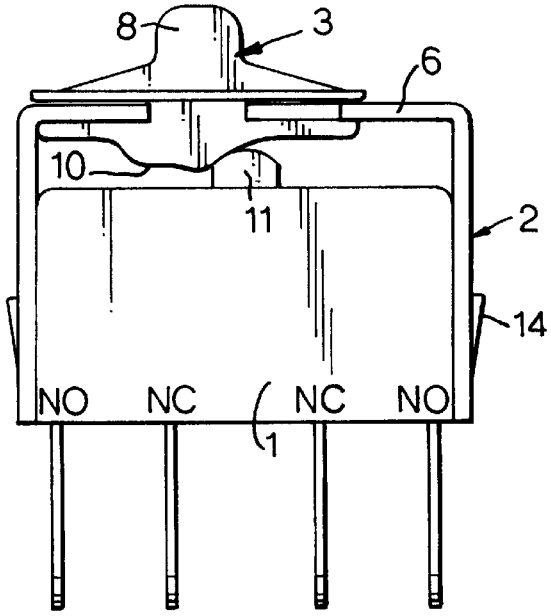
FIG. 2 is a side elevation of a switch in the "OFF" position.
Figure 3:
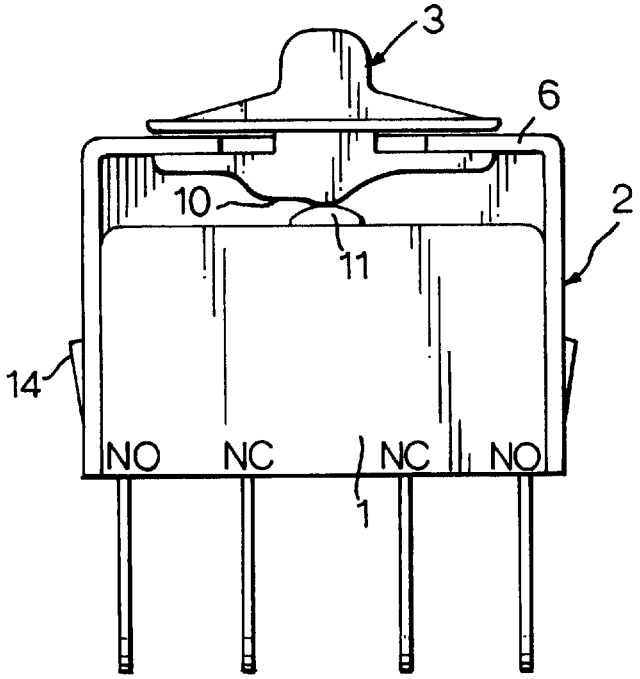
FIG. 3 is a side elevation of the switch in an intermediate position.
Figure 4:
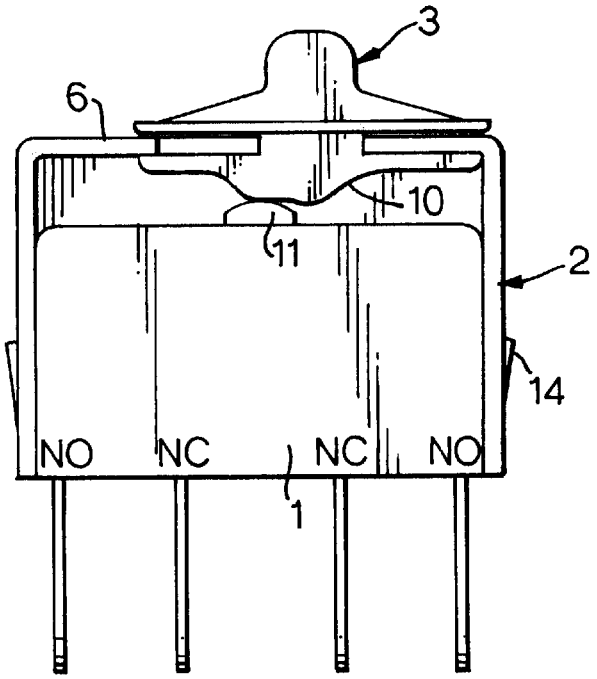
FIG. 4 is a side elevation of the switch in the "ON" position.

In this example the microswitch 1 is of the type which has two contacts connected to terminals marked NO in FIGS. 2 to 4 which are normally open and two contacts connected to terminals marked NC which are normally closed. In the normal or unactuated position as shown in FIG. 2 the slider 3 is located at the extreme leftmost position and in this position the plunger 11 of the microswitch 1 is in its outermost position. As the slider 3 is moved towards the right, as shown in FIG. 2, the profiled cam surface 10 causes the plunger 11 to be depressed into an extreme depressed position as shown in FIG. 3 before allowing it to release slightly into the position shown in FIG. 4 when the slider 3 reaches its extreme rightmost position. This is the actuated position of the microswitch and thus, in this position a connection is established between the NO terminals and there is no connection between the NC terminals. The "over-centre" profile of the cam surface 10 ensures that the slider 3 does not return inadvertently to its unactuated position, for example, as a result of vibration. However it can of course be returned manually to change the state of the microswitch 1.

Figure 5:
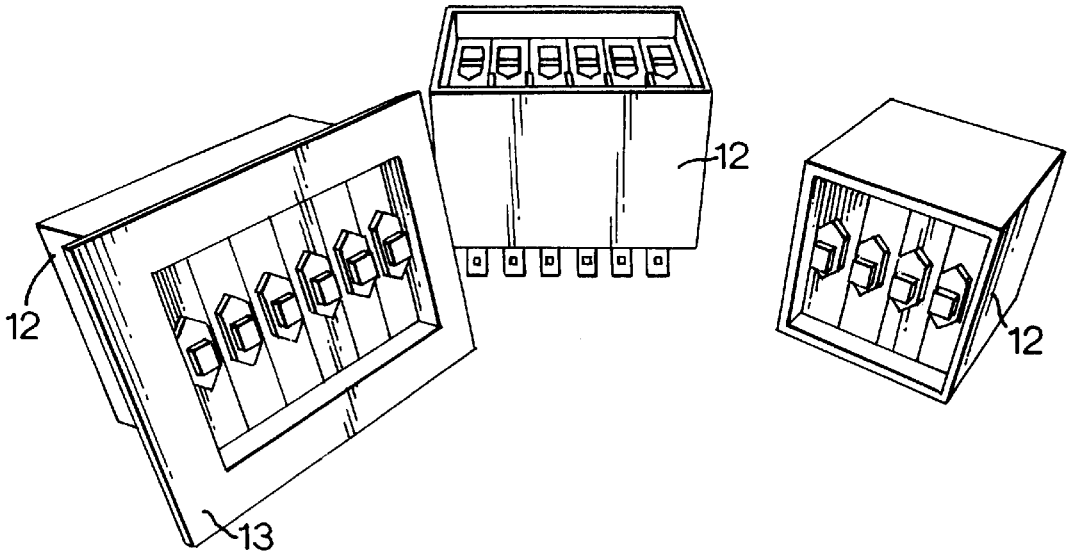
FIG. 5 is a perspective view of ganged arrangements of switches in accordance with this invention.

FIG. 5 illustrates three examples of gangs of slider switch assemblies. On the left is shown a six pole panel mounting slide switch assembly, in the centre is a six pole PCB mounting slider switch assembly and on the right is a four pole PCB mounting slide switch assembly. In each of these switch assemblies, switches as shown in the previous drawings are inserted side-by-side in a casing 12 which, for the panel mounting arrangement includes a flange 13. The switches are held in the frame 12 by the projections 14 shown most clearly in FIGS. 1 to 4.

We claim:

1. A slider actuated switch comprising:

a microswitch switching mechanism including a biased plunger mounted in a body;

a slider mounted on and co-operating with the body so that said slider is slidable backwards and forwards along the body; and a cam associated with the slider and engaging the biased plunger as the slider is moved backwards and forwards to operate the plunger and thereby actuate the microswitch switching mechanism;

wherein the cam is profiled to provide an "over-centre" action.

2. A slider actuated switch as claimed in claim 1, wherein the slider is slidable along the body back and forth between first and second extreme positions via a central position located between said first and second extreme positions;

the plunger has a fully depressed position at which the microswitch switching mechanism is actuated;

when the slider is at the first extreme position, the slider is either out of contact with the plunger or at least only just touching the plunger; and as the slider is moved towards the second extreme position from the first extreme position, the cam is profiled to engage the plunger and depress the plunger to the fully depressed position as the slider is at the central position and then to release the plunger slightly when the slider reaches the second extreme position.

3. A gang of slider switches, comprising a plurality of slider actuated switches, stacked next to one another, wherein each of said slider actuated switches comprises a microswitch switching mechanism including a biased plunger mounted in a body;

a slider mounted on and co-operating with the body so that said slider is slidable backwards and forwards along the body; and a cam associated with the slider and engaging the biased plunger as the slider is moved backwards and forwards to operate the plunger and thereby actuate the microswitch switching mechanism; and each of said slider actuated switches includes two tangs so that said slider actuated switch engages walls of a surrounding mounting frame or case holding the slider actuated switches in position side-by-side.

4. A gang of slider switches as claimed in claim 3, wherein each of said slider actuated switches further has a track which constrains and co-operates with the respective slider to control movements of said slider back and forth along said body, one side of the track being entirely open to facilitate assembly of the slider with the track; and said slider actuated switches are arranged side-by-side with the slider in each of said slider actuated switches being prevented from being removed from the respective track either by a neighboring one among said slider actuated switches or by a side wall of the mounting frame or case in which all of the slider actuated switches are mounted.

5. A slider actuated switch as claimed in claim 1 wherein the microswitch switching mechanism further comprises a frame provided with a track, said track constraining and co-operating with the slider to control movements of said slider back and forth along said body.

6. A switch, comprising:

a switching mechanism including a retractable plunger, said plunger having an extended position, a retracted position, and an intermediate position between said extended position and said retracted position; and an actuating element movable relative to the plunger, said actuating element having a cam surface engageable with the plunger, the cam surface having first, second and third sections with the second section being located between the first section and the third section;

wherein the plunger assumes the extended position when the first section of said cam surface arrives at the plunger, the plunger assumes the retracted position when the second section of said cam surface arrives at the plunger, and the plunger assumes the intermediate position when the third section of said cam surface arrives at the plunger.

7. A switch as claimed in claim 6, wherein the switching mechanism is a microswitch switching mechanism.

8. A switch as claimed in claim 6, wherein said switching mechanism is in a unactuated state when the plunger assumes the extended position, said switching mechanism is in an actuated state when the plunger assumes the retracted position, and said switching mechanism is maintained in the actuated state when the plunger assumes the intermediate position.

9. A switch as claimed in claim 8, wherein the plunger is biased by a biasing force in a direction from the retracted position towards the intermediate position and further towards the extended position.

10. A switch as claimed in claim 6, wherein the second section of the cam surface engages the plunger and depresses the plunger into the retracted position when the second section of the cam surface arrives at the plunger.

11. A switch as claimed in claim 6, wherein the third section of the cam surface engages the plunger and maintains the plunger in the intermediate position when the third section of the cam surface arrives at the plunger.

12. A switch as claimed in claim 9, wherein the actuating element is slidable relative to the plunger, back and forth between limits defined by two stop elements;

when the actuating element reaches one of said stop elements, the plunger is allowed by the first section of the cam surface to assume the extended position; and when the actuating element reaches the other of said stop elements, the plunger is engaged by the third section of the cam surface to assume the intermediate position.

13. A switch as claimed in claim 12, wherein when the actuating element reaches a middle point between said stop elements, the plunger is engaged by the second section of the cam surface and depressed into the retracted position.

14. A switch as claimed in claim 9, wherein a movement of the actuating element in a direction from one of said first and third sections towards the other of said first and third sections requires the biasing force acting on the plunger to be overcome when the plunger is depressed into the retracted position.

15. A switch as claimed in claim 6, wherein the switching mechanism further includes a body in which the plunger is mounted, said switch further comprising a frame attached to the body, said actuating element being movably supported by said frame.

16. A switch as claimed in claim 15, wherein said frame includes a wall having an aperture spanning over the plunger, said aperture constraining and co-operating with the actuating element to control movements of said actuating element along said aperture, said aperture being open to an edge of said wall to facilitate assembly of the actuating element with the aperture.

17. A gang of switches, comprising a plurality of switches stacked next to one another and a mounting frame or case in which all of the switches are mounted, wherein each of said switches comprises a switching mechanism including a biased plunger mounted in a body;

an actuating element movable relative to said plunger and having a cam surface engageable with the biased plunger as the actuating element is moved relative to the plunger to operate the plunger and thereby actuate the switching mechanism; and a wall having an aperture spanning over the plunger, said aperture constraining and co-operating with the actuating element to control movements of said actuating element along said aperture, said aperture being open to an edge of said wall to facilitate assembly of the actuating element with the aperture; and said switches are arranged side-by-side with the slider in each of said switches being prevented from being removed from the respective aperture either by a neighboring one among said switches or by a side wall of said mounting frame or case.

18. A gang of switches as claimed in claim 17, wherein each of said switches further includes at least one projection that engages a wall of said mounting frame or case holding the switches in position side-by-side.

19. A gang of switches as claimed in claim 17, wherein, for each of said switches, said plunger has an extended position, a retracted position, and an intermediate position between said extended position and said retracted position, the cam surface has first, second and third sections with the second section being located between the first section and the third section, and the plunger assumes the extended position when the first section of said cam surface arrives at the plunger, the plunger assumes the retracted position when the second section of said cam surface arrives at the plunger, and the plunger assumes the intermediate position when the third section of said cam surface arrives at the plunger.

20. A gang of switches as claimed in claim 19, wherein, for each of said switches, said switching mechanism is in a unactuated state when the plunger assumes the extended position, said switching mechanism is in an actuated state when the plunger assumes the retracted position, and said switching mechanism is maintained in the actuated state when the plunger assumes the intermediate position; and the plunger is biased by a biasing force in a direction from the retracted position towards the intermediate position and further towards the extended position.

* * * * *